US007275342B2

(12) United States Patent
Medvedeo

(10) Patent No.: US 7,275,342 B2
(45) Date of Patent: Oct. 2, 2007

(54) SEMI-AUTOMATIC WEAPON FOR SEVERAL TUBES CARTRIDGES LOADING SYSTEM FOR LONG GUNS

(76) Inventor: Juan Francisco Mautone Medvedeo, Battlle y Ordonez 1043, Minas, Lavelleia (UY)

( * ) Notice: Subject to any disclaimer, the term of this patent is extended or adjusted under 35 U.S.C. 154(b) by 251 days.

(21) Appl. No.: 10/848,657

(22) Filed: May 19, 2004

(65) Prior Publication Data

US 2007/0119085 A1 May 31, 2007

(30) Foreign Application Priority Data

Aug. 15, 2003 (UY) ..... U3970

(51) Int. Cl.
*F41C 7/00* (2006.01)

(52) U.S. Cl. ..... 42/19; 89/33.17; 42/75.02; 42/76.01

(58) Field of Classification Search ..... 42/19, 42/75.02, 76.01; 89/33.17
See application file for complete search history.

(56) References Cited

U.S. PATENT DOCUMENTS

| | | | | |
|---|---|---|---|---|
| 963,171 | A * | 7/1910 | Pedersen | 42/17 |
| 1,420,471 | A * | 6/1922 | Carter | 42/19 |
| 2,324,775 | A * | 7/1943 | Hentschel | 42/2 |
| 2003/0093935 | A1 * | 5/2003 | Huston | 42/76.02 |

* cited by examiner

*Primary Examiner*—Michael J. Carone
*Assistant Examiner*—Gabriel J. Klein
(74) *Attorney, Agent, or Firm*—Evelyn A. Defilló; Defillo & Associates, Inc.

(57) ABSTRACT

New design for semi-automatic weapon for several tubes cartridges loading system for long guns, wherein an in-between connection steel part fixes the barrel to the receiver. The retention of the cartridges inside the parallel tubes is done by three metallic nails. The springs of the loading tubes push the cartridges into the cylinder inside the gun through three openings made into the front side of the receiver under the barrel. The rotation mechanism of the cylinder is a result of changing the movement of the bolt from horizontal into vertical.

3 Claims, 14 Drawing Sheets

SEMI-AUTOMATIC WEAPON FOR SEVERAL TUBES CARTRIDGES LOADING SYSTEM FOR LONG GUNS

FIELD OF THE INVENTION

The invention concerns to semi-automatic shotguns for military or police use.

DESCRIPTION OF THE PRIOR ART

The known semi-automatic shotguns have a restricted loading capacity since, without modifying too much the desired size of a modern fighting shotgun, they can carry a maximum of nine or ten cartridges. This is because the cartridges are lodged aligned lengthwise in a tube that the weapon has under the barrel.

If the magazine is extended to increase the loading capacity, the barrel must be extended too. This is undesirable in this type of shotgun. The rest of the solutions to achieve a significant increase in the loading capacity which have been proposed so far, have resulted in increasing some of the dimensions of the weapons, making them uncomfortable and impractical to handle. As a consequence, they are not suitable for military or police use.

Other solutions have been proposed for known shotguns, such as Wagner, Bentley and alike. The applicant considers that said solutions are mere theoretical ones since they result in weakening or eliminating the magazine tube.

The actual function of the magazine tube in standard shotguns is to give resistance to their structure. The rear end of the barrel floats inside the receiver and becomes firm actually because it is attached to the front end of the magazine tube. So, if the magazine tube is weakened or eliminated, the barrel will be assembled without the necessary firmness.

On the other hand, the known shotguns of big loading capacity are slow or difficult to reload.

SUMMARY OF THE INVENTION

The present invention is designed to find the solution to the prior art problems.

The applicant tested said system in standard long guns. Two problems arose. Firstly, when the ex works magazine was removed in order to replace it with the cartridges loading system claimed in Record U 3714, the guns were no longer rigid enough to keep the barrel steady and firm. Also, the design of the standard weapons prevented the several barrels from being stable. To couple the cartridges loading system claimed in Record U 3714, it was necessary to modify the way of fixing the barrel to the receiver without the traditional magazine tube.

The second problem upon trying to use said cartridges loading system in standard long guns was, that it always resulted in a non ergonomic adaptation.

The weapons were heavier and uncomfortable to carry and take from one place to another. Thus, the inventor realized that they were not good solutions. The invention presented in this patent document is a new design of semi-automatic shotgun which incorporates the cartridges loading system described in Record U 3714 and makes it possible to use it properly. Said system solves the two problems by providing the necessary firmness and stability in order to operate the weapon, and by achieving an ergonomic, light, easy to carry design of semi-automatic shotgun for police and military use.

BRIEF DESCRIPTION OF THE INVENTION

Figure 1:
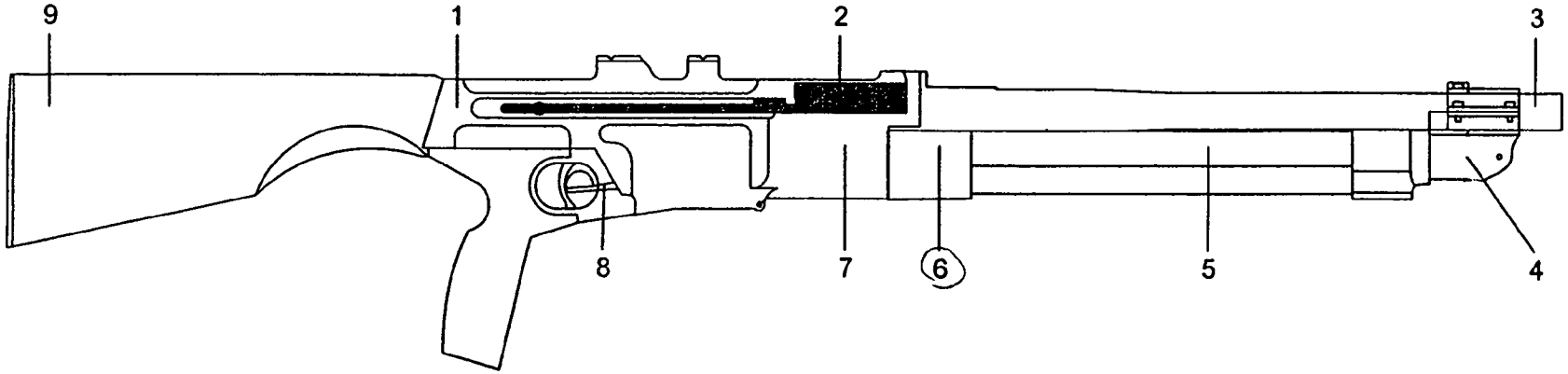
FIG. 1 shows the semi automatic weapon according to the present invention.

The utility model is a new design of semi-automatic shotgun whose main feature is an in-between connection steel part which fixes the barrel to the receiver. This steel part plays three roles. Firstly, it enables the magazine to float. As a result, the receiver can be manufactured in aluminum or plastic, thus making the gun lighter than the standard ones. Secondly, the barrel can be firmly attached to the receiver, thus providing stability. Thirdly, it works as a lock between the steel bolt and the barrel, so that it resists the explosion when the gun is fired, providing firmness. The firmness does not rely on an attached tube as in standard shotguns.

The in-between connection steel part is tube shaped. Its front end is screwed to the barrel, whereas its rear end lodges the bolt head, which is locked inside by two small balls which fit into cavities specially cut in the part. Transversely it comprises a perforated rectangular steel plate which is fixed to the end of the receiver by screws.

In order to attach the barrel and the receiver firmly, the barrel is screwed to the steel part, which, in turn, is fixed to the receiver by screws, preferably five of them.

The cartridges loading system is disclosed in Record U 3714. The mechanism which makes said cartridges loading system work consists in a receiver that contains the bolt, the trigger assembly and a four-canal cylinder connected to a cylinder hand, placed at the end of a two-axle pivot. The cylinder is made of plastic with four longitudinal canals symmetrically cut in their outer surface which have a semicircular section. The cylinder rotates automatically when the gun is fired. The rotation mechanism of the cylinder is a result of changing the movement of the bolt from horizontal into vertical, when the pivot balances firstly on a front axle, and secondly on a rear axle. The cylinder turns 90° clockwise every time the gun is shot.

The bolt slides inside a tube that goes through the receiver longitudinally, together with its inner pieces: inertial mass, nut, small balls and firing pin.

In an advantageous assembly model, the parallel tubes of said cartridges loading system surround the barrel, encircling its sides and lower part.

Their ends are fastened by fitting ends which keep them firmly attached. The magazine is fixed to the gun between the front side of the receiver and a lock with a handle fitted in the barrel near the front end. The retention of the cartridges inside the tubes is done by means of three metallic nails which emerge each from one tube and retain them by the shell head. The nails hold the shell head of the last cartridge, preventing the springs from dislodging them while the magazine is out of the shotgun. As soon as the magazine is placed and the lock with a handle is actuated, the retaining metal nails hide and release the cartridges.

The springs push and enable a cartridge from each tube to enter each canal of the cylinder through openings made into the front side of the receiver under the barrel.

As it is disclosed in Record U 3714, the bolt, which is aligned with the chamber, goes through the upper canal of the cylinder. It remains empty while the others have one cartridge each. When the operating handle of the bolt is operated, the double axle pivot balances and raises the hand which makes the cylinder rotate one fourth turn clockwise. Then, the cartridge in the left canal moves to the upper position, facing the chamber. At the same time, the empty upper canal turns right facing the right loading tube and receiving a cartridge therefore.

When the operating handle is released, the bolt is sent forwards by its recoil spring, and pushes the cartridge which is waiting inside the chamber. Once the gun is shot, the fired shell triggers the semi-automatic mechanism, similarly to that of an ordinary long firearm.

The bolt moves backwards and operates the pivot, which lifts the cylinder handle. Said hand makes the cylinder rotate another fourth turn and the cycle starts again. When all the cartridges in the right tube are discharged, the upper canal is not loaded and remains empty until the gun is fired again. Then, the empty canal aligns with the lower tube and receives a cartridge therefrom. Once the lower tube is empty, it is fed by the cartridges from the left tube. When it is discharged, the magazine is empty and can be replaced by a full one. To eject the magazine, the lever at the end of the barrel is released and the empty magazine is free to fall out the gun.

DESCRIPTION WITH REFERENCE TO ACCOMPANYING DRAWINGS

The following is a possible way of manufacturing the utility model hereby described.

FIG. 1: It is an overall description of the weapon where the parts are numbered 1 to 9. Said parts are described in the subsequent drawings with different numbering.

Figure 2:
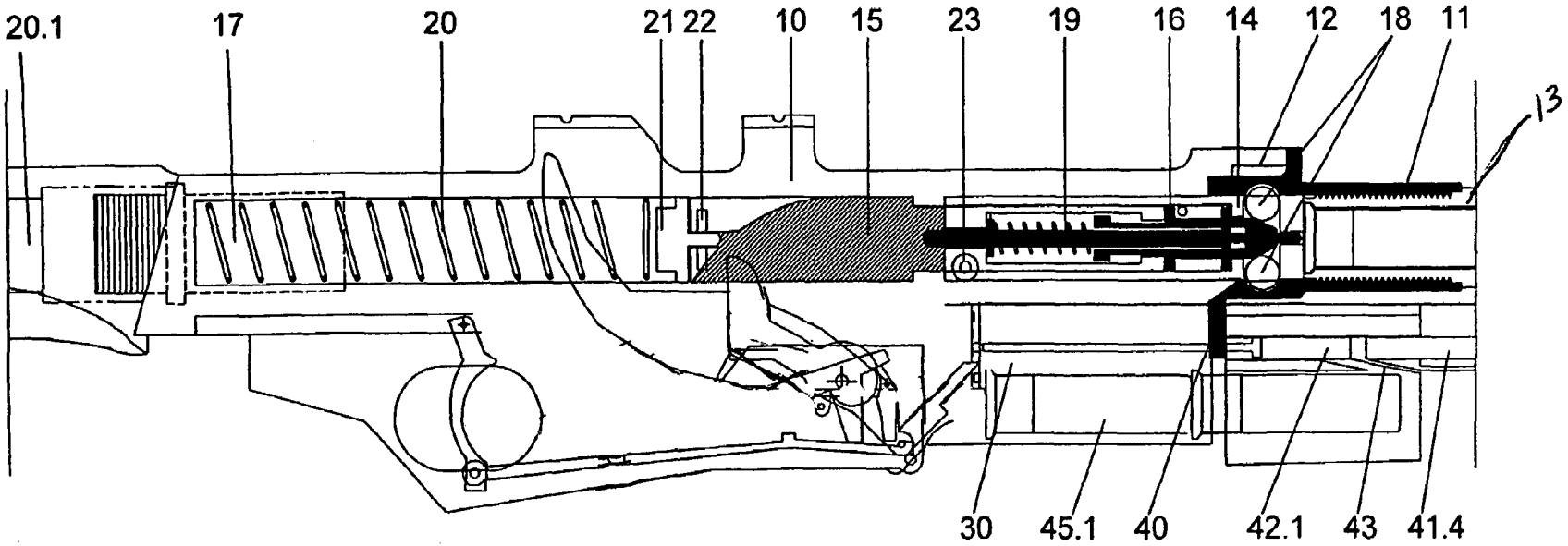
FIG. 2 shows a cross sectional view of the semi automatic weapon of FIG. 1.

1 the receiver
2 the bolt assembly
3 the barrel
4 the front lock of the magazine
5 the magazine
6 the bored plate between the magazine and the cylinder
7 the case of the cylinder
8 the trigger
9 the butt FIG. 2: the receiver (10) is fixed to the barrel (13) by the in-between connection steel part (11) which is screwed (12) to the receiver (10). The tube (17) goes through the receiver lengthwise. The bolt (14) runs through the tube together with its inner parts: inertial mass (15), nut (16), the small balls (18) and the firing pin (19). Behind this assembly and aligned to it, are the spring (20), the follower (21) and the running stop (20.1).

Figure 3:
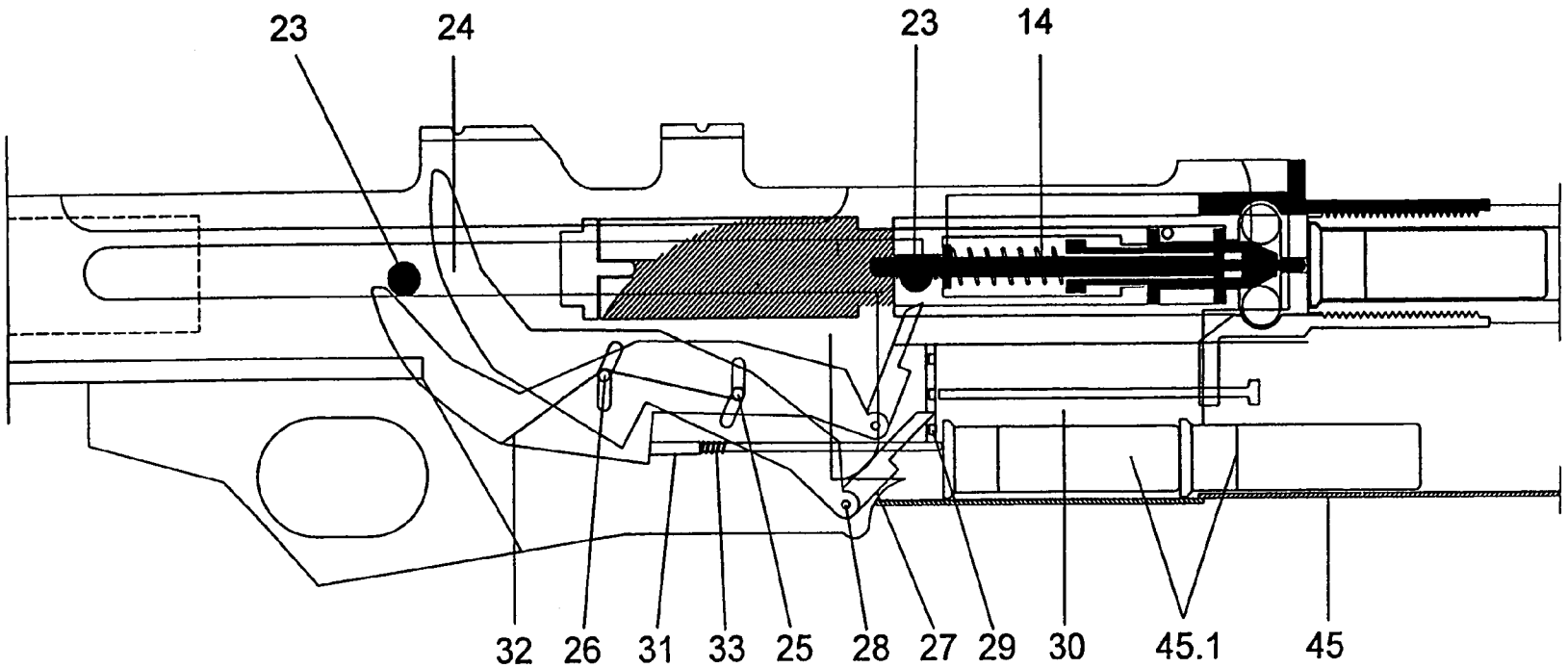
FIG. 3 shows a cross sectional view of the semi automatic weapon of FIG. 1 showing the details of the cylinder.

FIG. 3 illustrates how the cylinder rotates automatically when the gun is fired. After the shot, the bolt (14) moves backwards pushed by the shell. The small wheel (23) is fixed to the bolt (14) and it moves backwards as well. On its way, it slides into the sliding edge of the pivot 24, forcing it to pivot on axle 25 first and axle 26 afterwards. The hand (27), which is joined to the pivot (24) through the axle (28), goes up and pushes the small nuts (29) which comprise the cylinder star (30) and they make the cylinder rotate 90°. At the end of its way downwards, the pivot (24) pushes the cylinder stop (31) and sends it to one of the cavities the cylinder (30) has for that purpose. As the bolt (14) moves forwards again, the small wheel (23) releases the pivot (24) which returns to its position by means of the spring (32). It also releases the cylinder stop (31) which is sent back to its initial position by its spring (33) and disengages the cylinder (30). The bolt (14) occupies the upper canal of the cylinder (30) and secures its position.

Figure 4A:
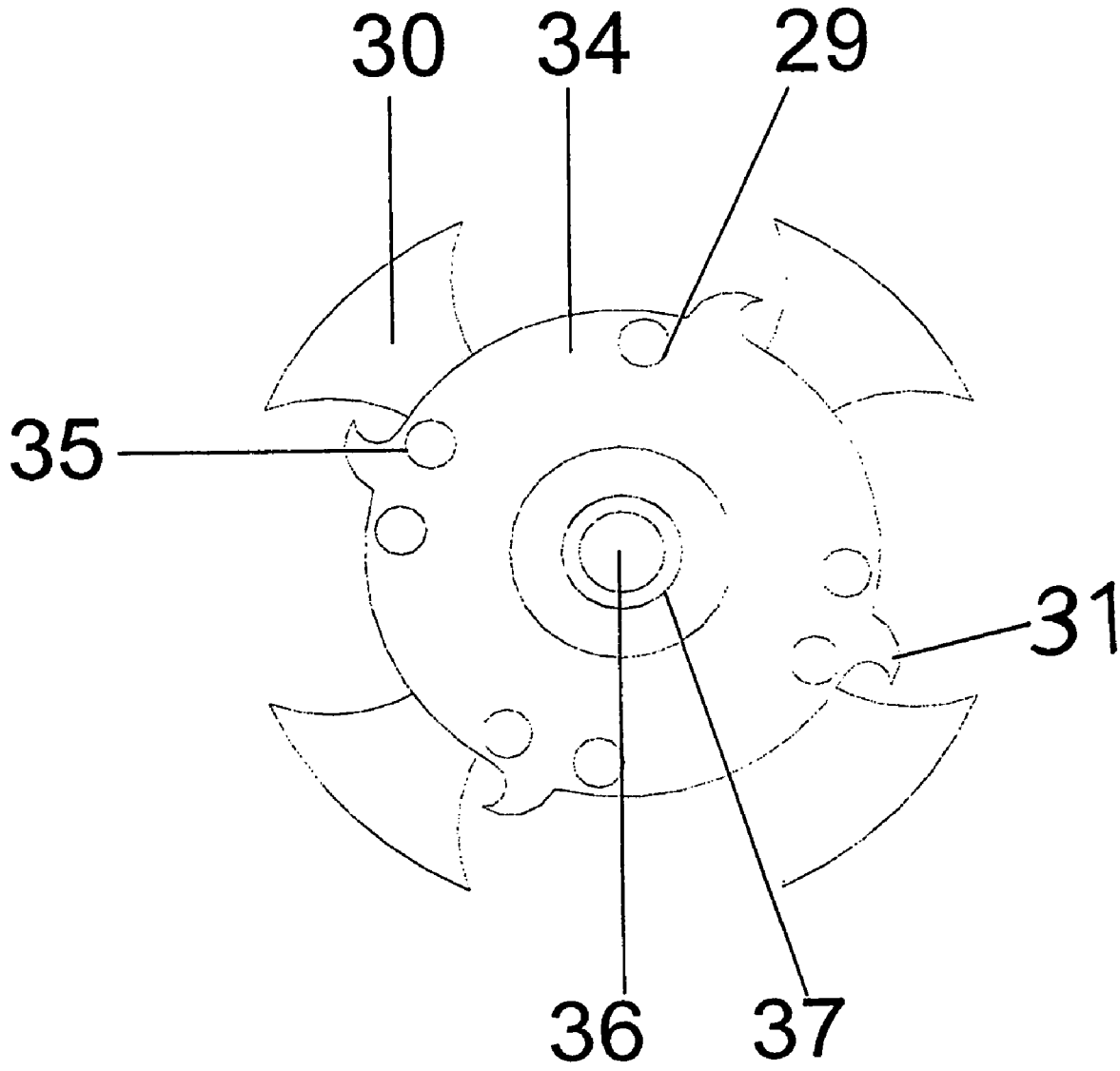
FIG. 4A shows a rear view of the cylinder according to the present invention.

In FIG. 4 A, we have a rear view of the cylinder (30) and the small nuts (29) (35) which are part of the steel star (34). We can see the holes where the cylinder stop fits and the central hole where the axle (36) that keeps the cylinder (30) positioned fits. Inside said hole there is a tube (37) which centers the cylinder (30) on the axle (36) and acts as a tighten separator while the cylinder is fit into the gun.

Figure 4B:
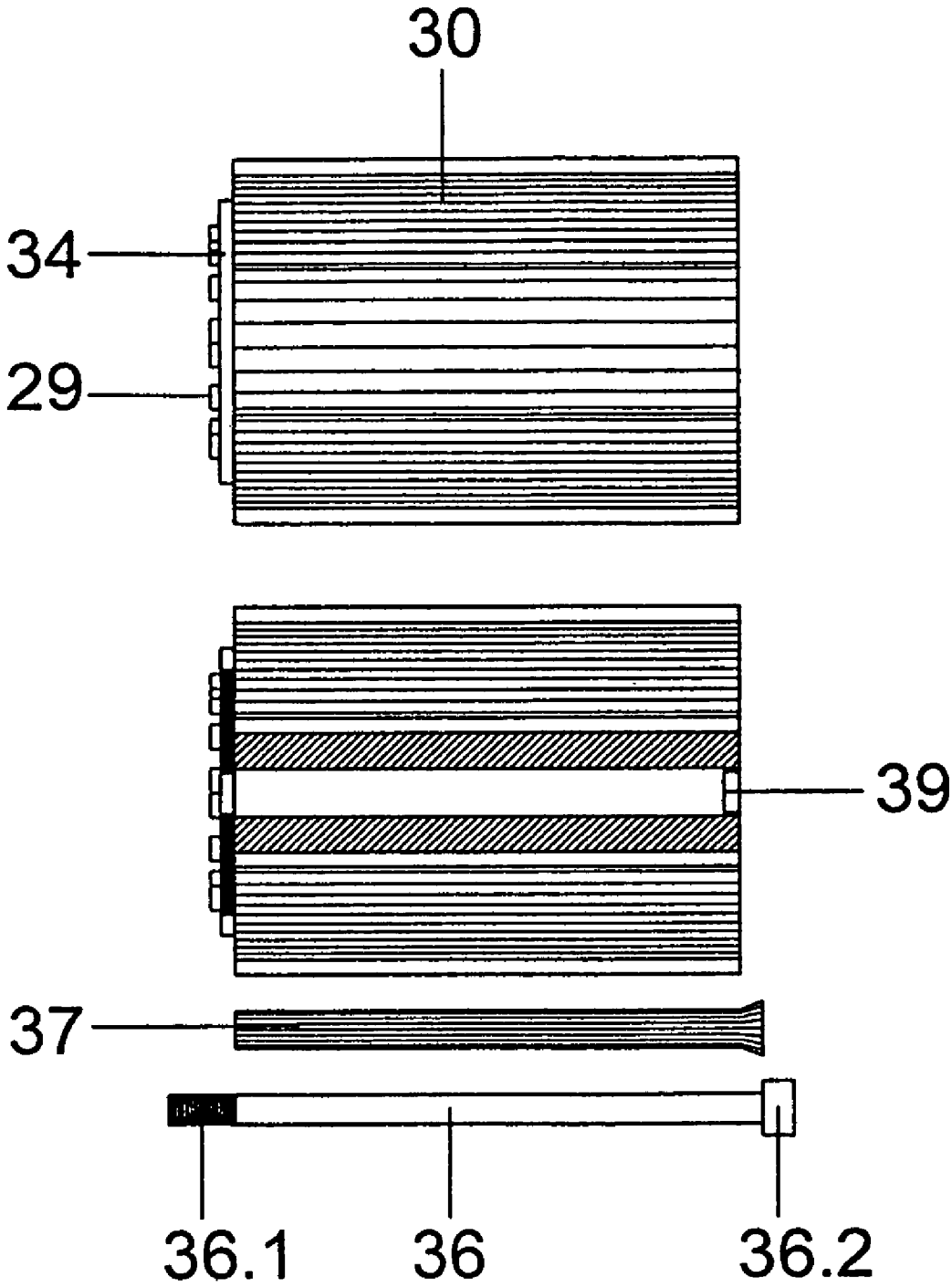
FIG. 4B shows a longitudinal sectional view of the cylinder according to the present invention.

In FIG. 4B, there is a longitudinal sectional view of the cylinder (30). It shows how the axle (36) is fixed to the receiver (10) by means of a threaded end (36.1). The other end forms an "allen" nut with a cylindric crown end (36.2). This axle (36) is firmly attached to the plate (40) which is embedded in the receiver (10). The separator (37) prevents the axle (36) from tightening the cylinder. The separator (37) has a cone shaped end to allow the bushing (39) of the cylinder (30) to slide with minimum friction.

Figure 4C:
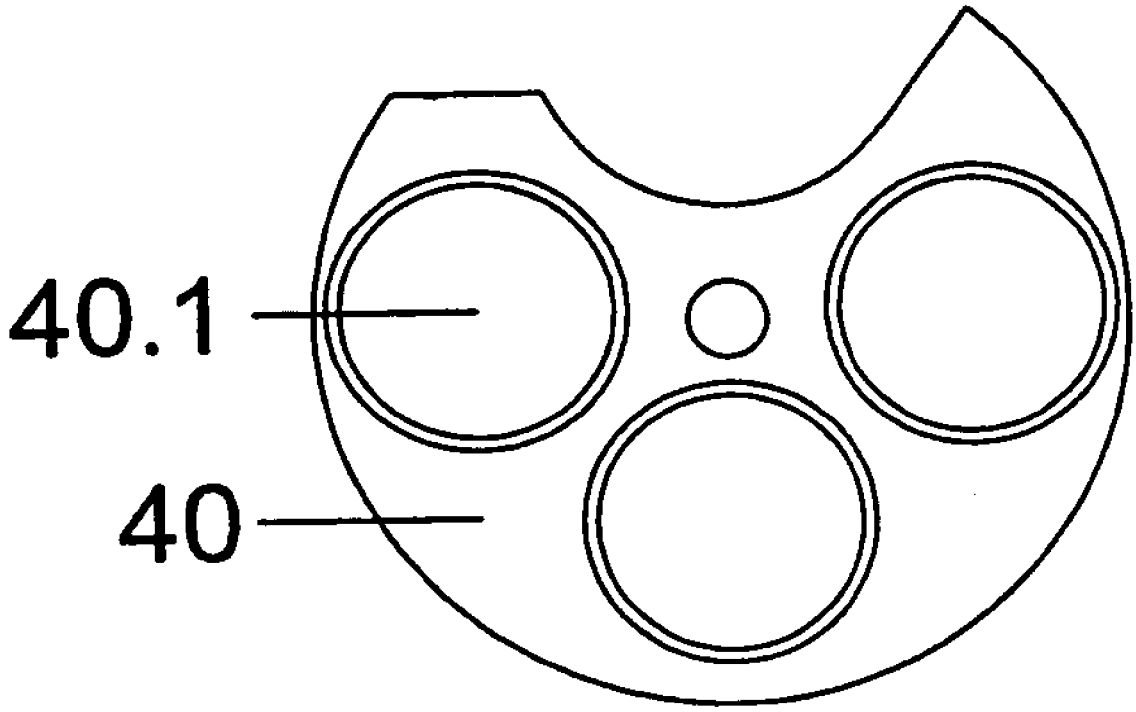
FIG. 4C shows a rear view of the bored plate according to the present invention.

In FIG. 4C, we have a rear view of the bored plate (40) with the round openings (40.1) through which the cartridges in the tubes (45) move from the magazine (41) to the cylinder (30).

Figure 5A:
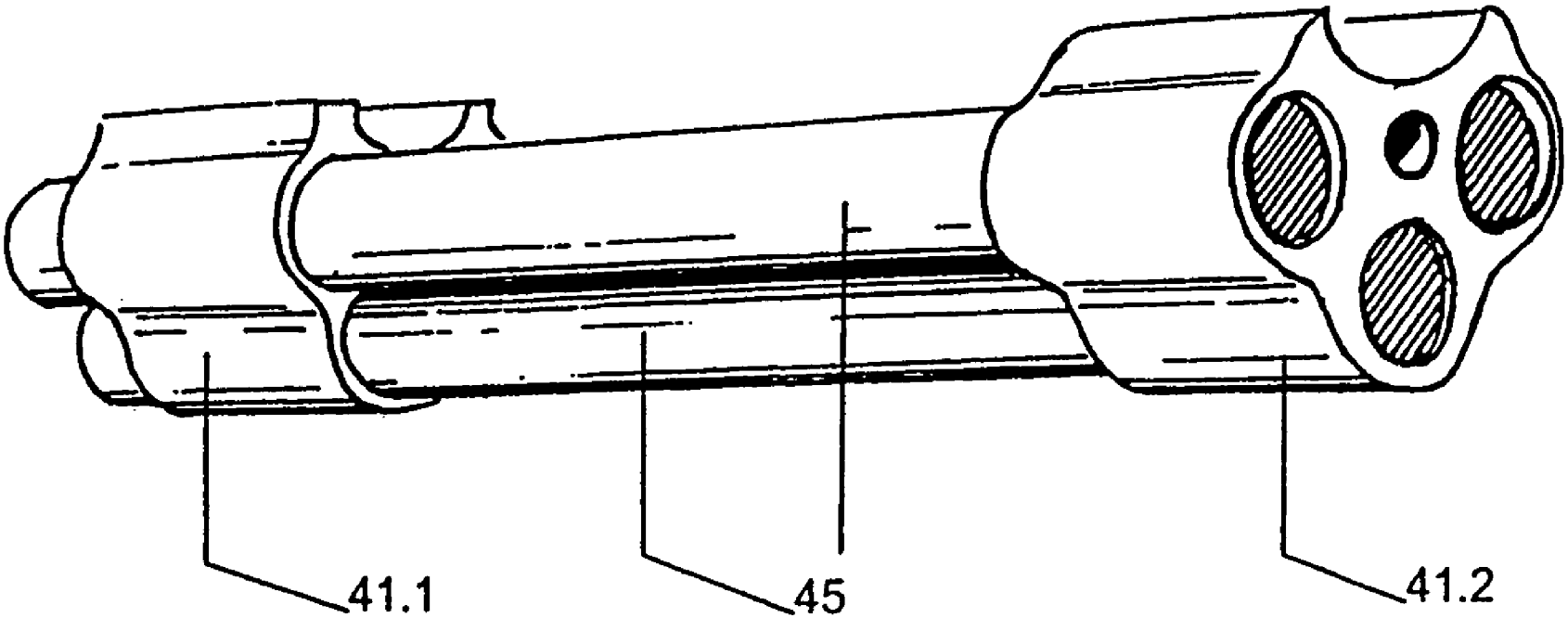
FIG. 5A shows a view of the magazine according to the present invention.
Figure 5B:
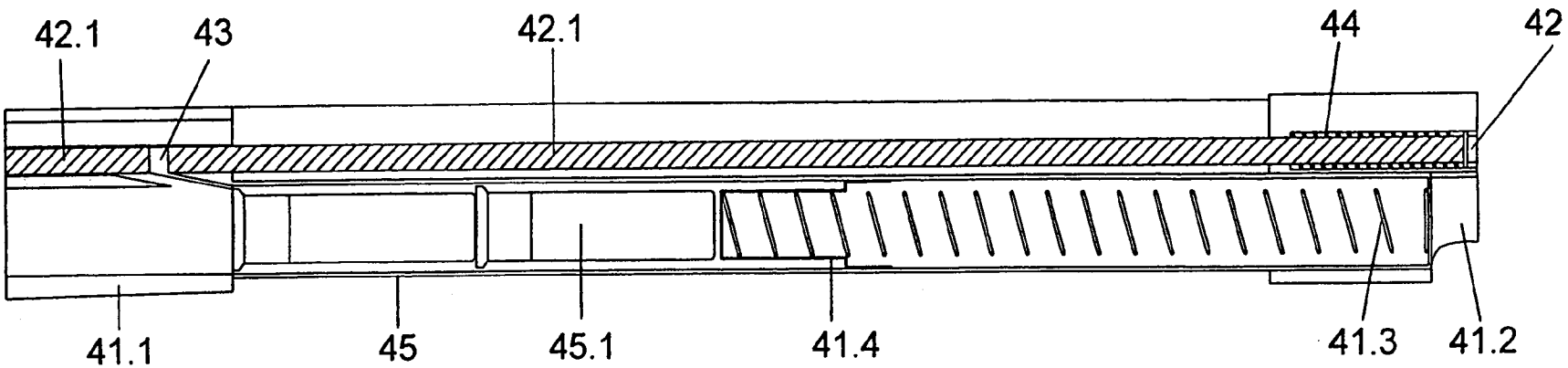
FIG. 5B shows a cross sectional view of the magazine according to FIG. 5A.

The magazine (41) comprises three identical tubes (45) located as seen in the diagram in FIG. 5A. They are a joint assembly by virtue of the fitting end (41.1) at the rear end, and fitting end (41.2) at the front end. The three tubes are open in their rear ends and closed in their front ends. There is a spiral spring (41.3) and a follower (41.4) in each one of them. The rod (42) that is part of the magazine assembly goes through the central axis of both fitting ends (41.1 and 41.2). At the front end (42.2) is the spring (44) which keeps the rod tensed forwards. When the tubes (45) are loaded, the cartridges are retained by the shell head of the last one by virtue of the nails (43) as shown in FIG. 5B.

Figure 6:
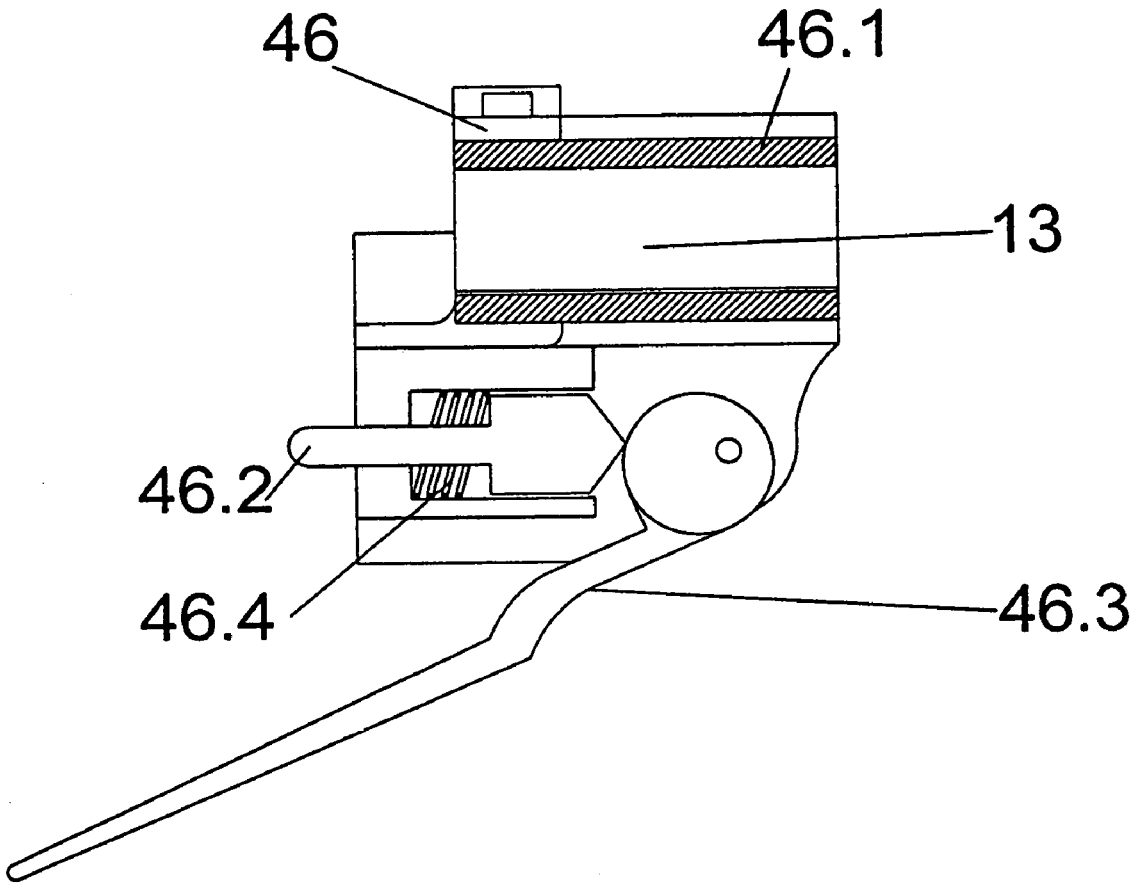
FIG. 6 shows a longitudinal sectional view of the fixing device according to the present invention.

When operating the gun (FIG. 6) a full magazine must be placed after removing the empty one, so that the rear side of the tubes (45) align with the openings (40.1), and the front side fits in the device (46) fixed near the front end of the barrel (13). The fixing device (46) comprises a main part (46.1) fastened to the barrel by the screws, and comprises a bolt (46.2) connected to a lever with cam (46.3) by means of the spring (46.4). When the lever (46.3) turns towards the barrel (13), the bolt (46.2) is pushed through the axle of the fitting (41.2) and pushes the rod (42) towards the receiver (10). The rear end (42.1) of the rod projects backwards and engages the cylindrical crown (36.2). As a result, the magazine (41) is firmly fixed to the gun. In addition, as the rod (42) moves backwards, it pulls the three nails (43) forcing them to hide under the wall of the three tubes (45) and releasing the cartridges which are pushed by the followers (41.4) and the springs (41.3). Three cartridges, one from each tube, enter the corresponding canals (30.1) of the cylinder (30) through the windows (40.1).

Figure 7:
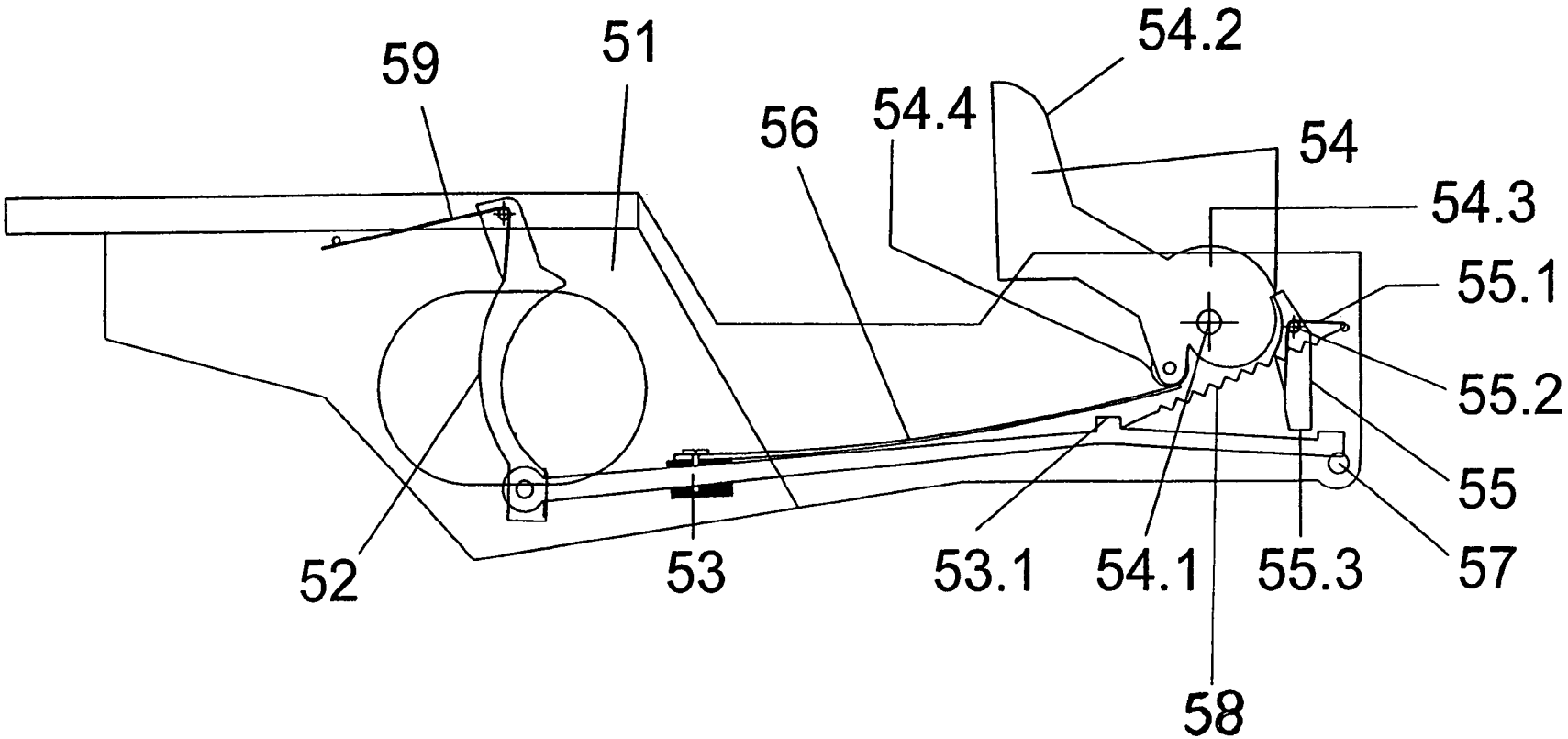
FIG. 7 shows a longitudinal sectional view of the firing mechanism according to the present invention.

In FIG. 7, we can see a longitudinal section of the firing mechanism (50), with the box (51), the trigger (52), the transferring bar (53), the hammer (54), the sear (55), the main spring (56), the sear spring (55.1), the axle (57) of the box (51), the axle (54.1) of the hammer (54), and the axle (55.2) of the sear (55). The system is assembled as follows: as the bolt (14) moves backwards, it pulls the point (54.2) of the hammer (54), and makes it turn around its axle (54.1) until—with the groove (54.3)—it mounts the sear (55). The spring (55.1) of the sear (55) keeps it in cocking position. The main spring (56) remains tense and pushes the small wheel (54.4). When the trigger (52) is pulled, the transferring bar (53) recoils and pulls the sear (55) tail (55.3). It disengages from the groove (54.3) of the hammer (54), and the gun is fired. The disengagement of the sear (55), which is necessary for the gun to be cocked again while the shooter pulls the trigger, occurs when the hammer (54) is mounted. This is because the main spring (56) stretches and presses the projection (53.1) of the transferring bar (53), thus pulling it down and releasing it from the tail (55.3). The springs (58 and 59) pull the trigger and its transferring bar back to position.

Figure 8A:
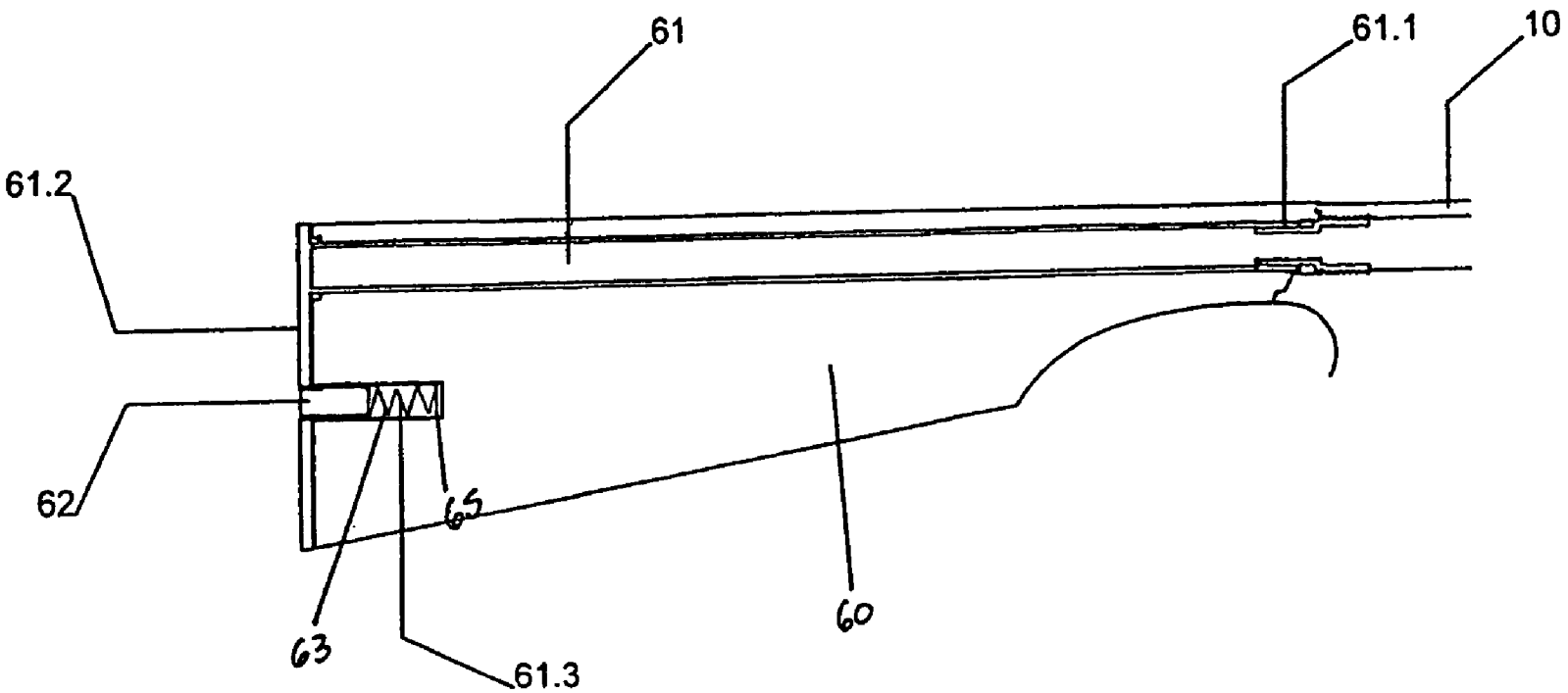
FIG. 8A shows a sectional view of the butt according to the present invention.

FIG. 8A shows a section of the butt (60) with the tube (61). Its front end is screwed, and its rear end is fixed to the butt plate (61.2). It also shows the lock (62) with holes (61.3) and its spring (63) and cup (65) which lodges the lock assembly (62). The butt (60) can be disconnected without using tools so that it occupies little room when carried, and in order to remove the bolt assembly (13) as well. The tube (61) is firmly attached to the butt plate (61.2). The butt plate is kept into position by the lock (62) which enters the hole and prevents it from rotating. The butt (60) is retained because it is tightened between the receiver (10) and the butt plate (61.2). In order to remove the butt (60), it is necessary to press down the lock (62) and turn the butt plate (61.2) until the tube (61) is completely unscrewed from the screwed lodging (61.1). Once the butt (60) and the tube (61) have been removed, the recoil spring (20), together with the follower (21), can be removed from the rear side of the receiver (10). As a result, the bolt assembly (14) is released.

Figure 8B:
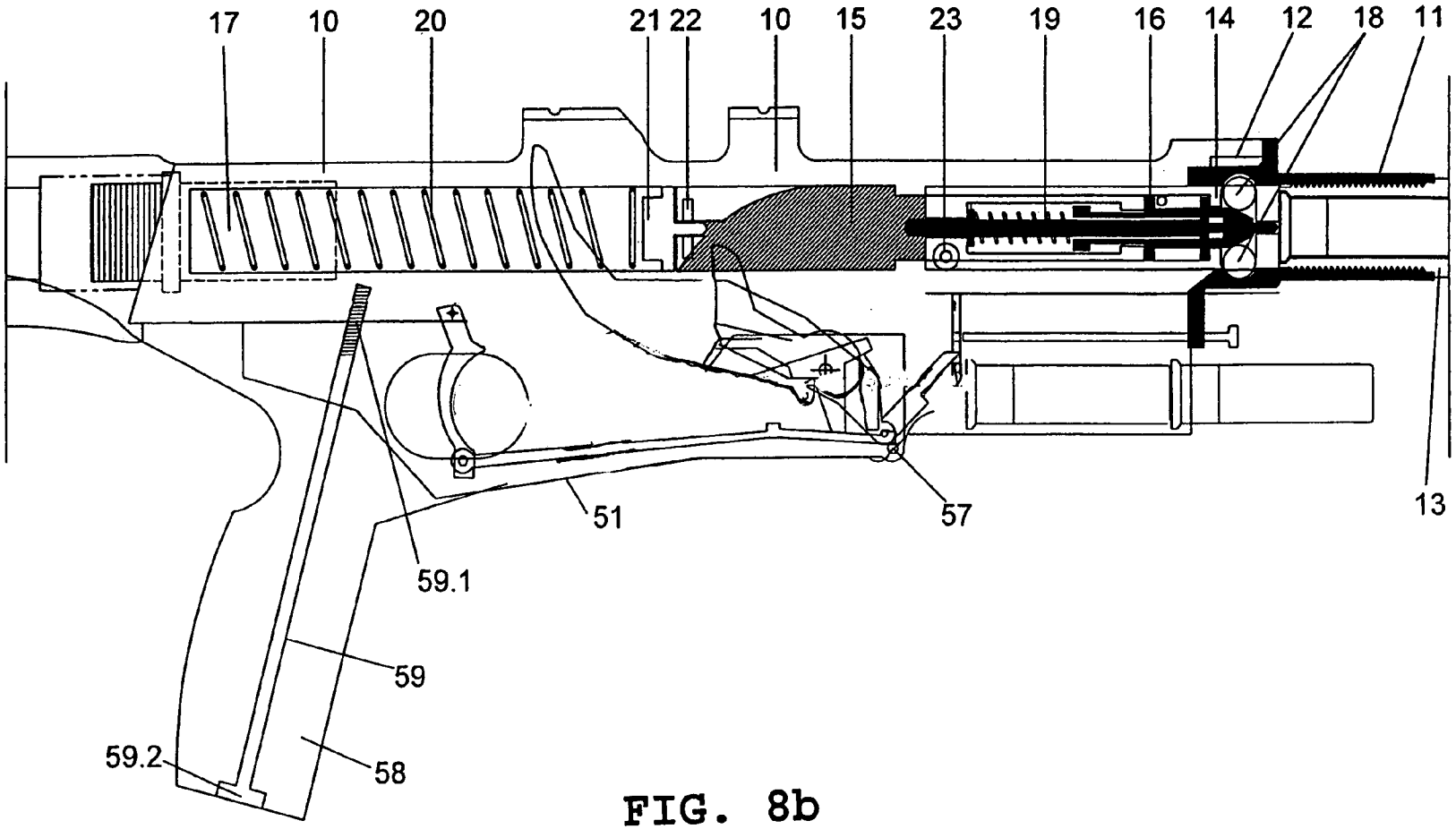
FIG. 8B shows a cross sectional view of the weapon according to the present invention showing the butt.
Figure 9:
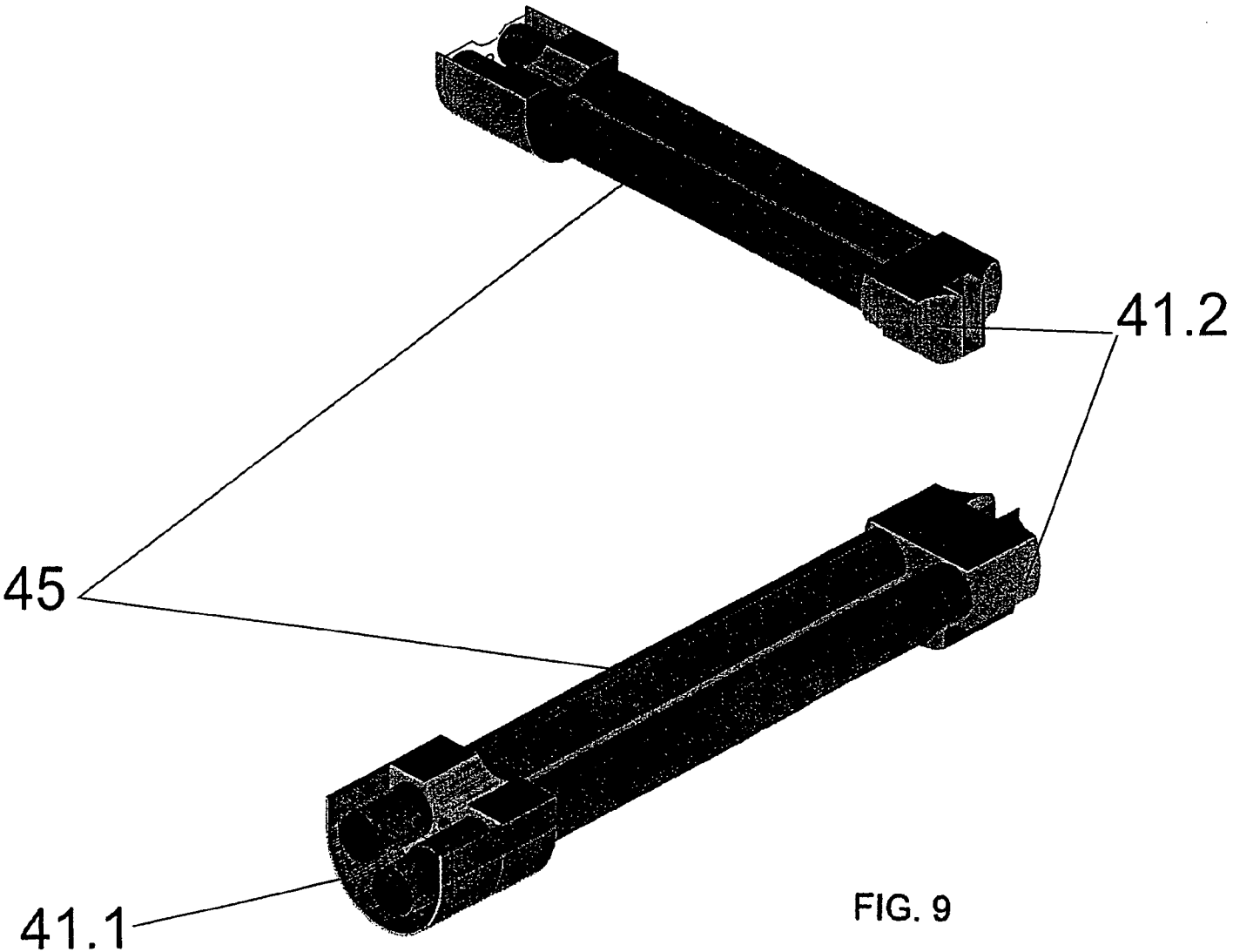
FIG. 9 shows a cross sectional view of the four canal cylinder having semicircular sections according to the present invention.
Figure 10:
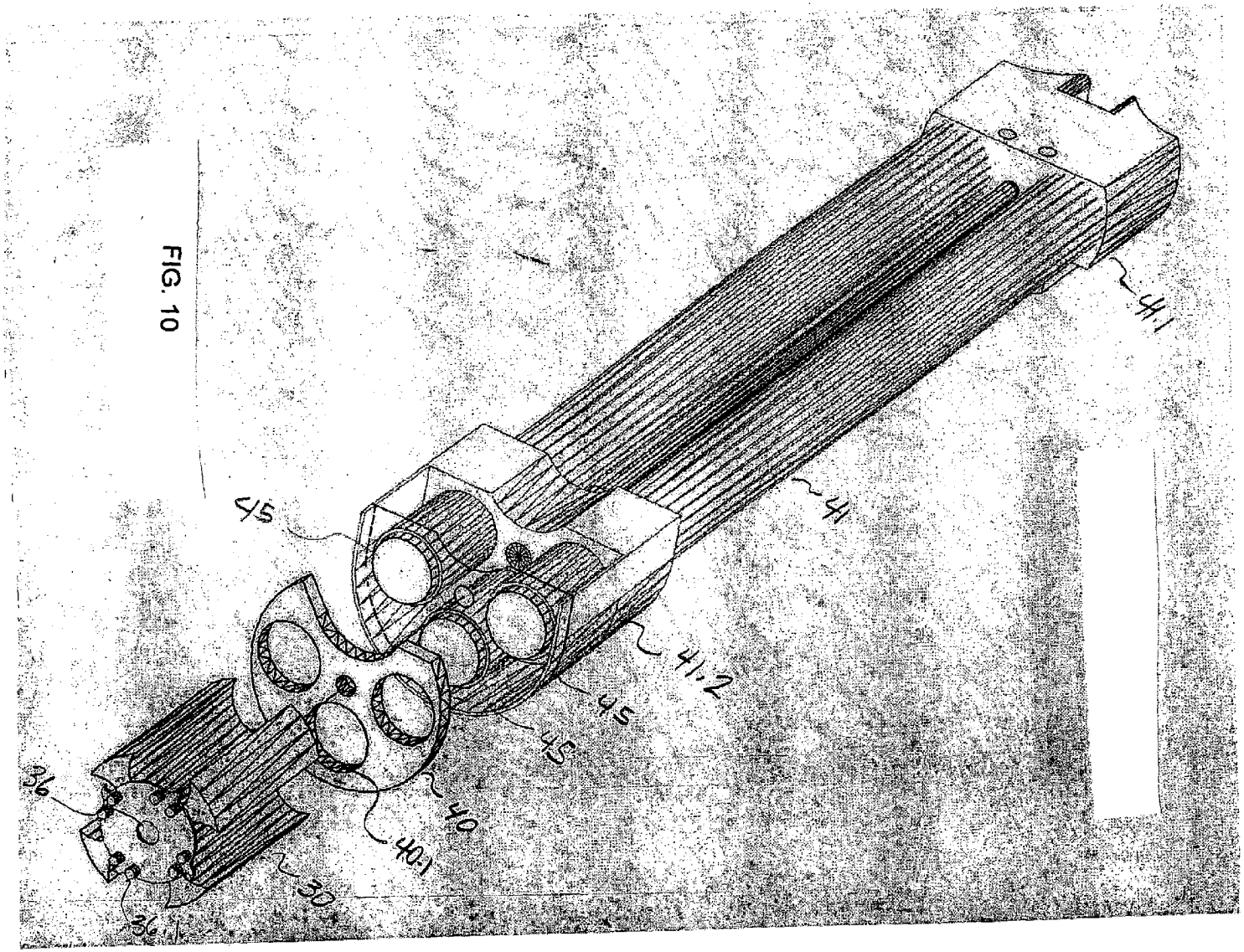
FIG. 10 shows a detailed projected view of the cylinder, plate, and magazine assembly.

In FIG. 8B, the box (51) can be folded downwards around the axle (57) without using any tools, in order to check or do outdoor cleaning. It is only necessary to turn the wheel (59.2) of the rod (59), which is screwed (59.1) to the receiver (10).

INDUSTRIAL APPLICATION

The utility model herein claimed, as well as its parts, can be manufactured and reproduced according to the usual methods known to gun manufacturers. It should be taken into account that the in-between connection steel part must be hardened through thermal treatment.

What is claimed is:

1. A semi automatic weapon for several tubes cartridges loading system for long guns comprising:

a barrel;

a receiver having a front end and a rear end, wherein the barrel is firmly connected to the front end of the receiver by a in-between connection steel part;

a butt connected to the rear end of the receiver;

a magazine located underneath of the barrel and in front of the receiver, the magazine having at least one tube;

a trigger; and a cylinder contained inside the receiver and a bored plate located between the magazine and the cylinder;

wherein the cylinder turns 90° every time the weapon is shot.

2. A semi automatic weapon according to claim 1, wherein the bored plate contained inside the receiver includes one opening per each tube of the magazine to move a cartridges from the magazine to the cylinder.

3. A semi automatic weapon according to claim 1, wherein the barrel is screwed to the in-between steel part.

* * * * *

UNITED STATES PATENT AND TRADEMARK OFFICE

CERTIFICATE OF CORRECTION

PATENT NO. : 7,275,342 B2
APPLICATION NO. : 10/848657
DATED : October 2, 2007
INVENTOR(S) : Juan Francisco Mautone Medvedeo It is certified that error appears in the above-identified patent and that said Letters Patent is hereby corrected as shown below:

On The Title Page,

(12) United States Patent
MEDVEDEO should read as:

(12) United States Patent
MAUTONE

Signed and Sealed this

Eleventh Day of December, 2007

JON W. DUDAS
*Director of the United States Patent and Trademark Office*